US008398442B2

(12) United States Patent
Yagi et al.

(10) Patent No.: US 8,398,442 B2
(45) Date of Patent: Mar. 19, 2013

(54) TERMINAL FITTING AND A METHOD FOR ASSEMBLING THE SAME

(75) Inventors: Sakai Yagi, Shizuoka (JP); Nobuaki Yoshioka, Shizuoka (JP); Ikuo Morita, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 13/259,823

(22) PCT Filed: Sep. 2, 2010

(86) PCT No.: PCT/JP2010/064996
§ 371 (c)(1),
(2), (4) Date: Sep. 23, 2011

(87) PCT Pub. No.: WO2011/030712

PCT Pub. Date: Mar. 17, 2011

(65) Prior Publication Data

US 2012/0009828 A1 Jan. 12, 2012

(30) Foreign Application Priority Data

Sep. 8, 2009 (JP) ..... 2009-207426

(51) Int. Cl.
*H01R 13/04* (2006.01)

(52) U.S. Cl. ..... 439/693; 439/181

(58) Field of Classification Search ..... 439/181, 439/693, 884
See application file for complete search history.

(56) References Cited

U.S. PATENT DOCUMENTS

| | | | | |
|---|---|---|---|---|
| 2,537,370 | A * | 1/1951 | Parnes | 439/693 |
| 6,113,436 | A | 9/2000 | Kuwahara et al. | |
| 6,146,211 | A | 11/2000 | Okamoto et al. | |
| 6,554,623 | B2 * | 4/2003 | Yoshioka | 439/98 |
| 6,918,800 | B2 * | 7/2005 | Ota et al. | 439/886 |

(Continued)

FOREIGN PATENT DOCUMENTS

| | | | |
|---|---|---|---|
| JP | 2000003750 | A | 1/2000 |
| JP | 2000150040 | A | 5/2000 |

(Continued)

OTHER PUBLICATIONS

International Search Report and Written Opinion (in Japanese) dated Dec. 28, 2010.

*Primary Examiner* — James Harvey
(74) *Attorney, Agent, or Firm* — Edwards Wildman Palmer LLP; James E. Armstrong, IV

(57) ABSTRACT

A male terminal comprises an electrical contact portion and an insulating member made of insulating material. The electrical contact portion is inserted into and connected to a female terminal. The insulating member includes a to-be-received portion accommodated in the electrical contact portion and a to-be-exposed portion. The electrical contact portion includes a bottom wall upon which the to-be-received portion is disposed, and a top wall. The to-be-received portion is positioned between the bottom wall and the top wall having a securing engagement portion brought into engagement with the to-be-received portion. The male terminal is made by placing the to-be-received portion upon the bottom wall while the bottom wall, the top wall, and the securing engagement portion are flush with each other, bending them such that the to-be-received portion resides between the top wall and the bottom wall, and bringing the securing engagement portion into engagement with the to-be-received portion.

8 Claims, 6 Drawing Sheets

U.S. PATENT DOCUMENTS

| | | | | |
|---|---|---|---|---|
| 7,163,753 | B2 * | 1/2007 | Ota et al. | 428/647 |
| 2003/0194893 | A1 * | 10/2003 | Ota et al. | 439/181 |
| 2004/0137772 | A1 * | 7/2004 | Ota et al. | 439/181 |
| 2008/0146090 | A1 | 6/2008 | Shimizu | |
| 2012/0009828 | A1 * | 1/2012 | Yagi et al. | 439/884 |
| 2012/0040571 | A1 * | 2/2012 | Yoshioka et al. | 439/736 |

FOREIGN PATENT DOCUMENTS

| | | | |
|---|---|---|---|
| JP | 2008153074 | A | 7/2008 |

* cited by examiner

TERMINAL FITTING AND A METHOD FOR ASSEMBLING THE SAME

CROSS REFERENCE TO RELATED APPLICATIONS

This application is a U.S. National stage application pursuant to 35 U.S.C. §371 of International Application No. PCT/JP2010/064996, filed Sep. 2, 2010, which claims the benefit of priority of Japanese Patent Application No. 2009-207426, filed Sep. 8, 2009, the disclosures of each of which are expressly incorporated herein by reference in their entireties.

TECHNICAL FIELD

The present invention relates to a terminal fitting adapted to be inserted in an electrical contact part of a mating terminal fitting for connection thereto, and a method for assembling the same.

BACKGROUND ART

Terminal fittings of various types have been conventionally used for connection to a mating terminal fitting (for example, see the patent literature PTL 1 and the patent literature PTL 2). The terminal fittings described in these patent literatures comprise a cylindrical electrical contact portion adapted to be inserted into an electrical contact part of the mating terminal fitting; a wire-connecting portion continuing to the electrical contact portion and adapted to be connected to an electrical wire; and an insulating member adapted to be attached to the electrical contact portion.

The insulating member is made of insulation material such as insulating synthetic resin, and includes in one piece therewith a to-be-received portion adapted to be inserted into the electrical contact portion, and a to-be-exposed portion that remains exposed via an end face of the electrical contact portion when the to-be-received portion is inserted into the electrical contact portion.

A retaining arm is provided at a periphery of the to-be-received portion. The retaining arm is adapted to be brought into locking engagement with a recess formed on an inner surface of the electrical contact portion.

The to-be-exposed portion is disposed in contact with the end face of the electrical contact portion. Also, the to-be-exposed portion has a taper shape tapering as it becomes away from the electrical contact portion.

Since the conventional terminal fittings described in the above patent literatures include the insulating member having the to-be-exposed portion covering the entire end face of the electrical contact portion, touching the top end portion does not cause electrical shock even when a large current flows.

CITATIONS LIST

Patent Literature

PTL 1: Japanese Patent Application Laid-Open Publication No. 2000-150040

PTL 2: Japanese Patent Application Laid-Open Publication No. 2000-3750

SUMMARY OF THE INVENTION

Technical Problem

In the case of such prior-art terminal fittings as described in the patent literature PTL 1 and the patent literature PTL 2, the to-be-received portion is press-fitted into the cylindrical electrical contact portion along an axis of the electrical contact portion, and the retaining arm is brought into licking engagement with the recess provided on the inner surface of the electrical contact portion, and thus the insulating member is mounted to the terminal fittings. This means that an elastically deformable retaining arm has to be provided on the to-be-received portion of the insulating member. Accordingly, when the to-be-received portion is press-fitted into the cylindrical electrical contact portion, the retaining arm may be broken as it is elastically deformed, which makes it difficult to mounting the insulating member to the electrical contact portion.

Also, it is necessary to provide a recess on an inner surface of the cylindrical electrical contact portion by cutting or machining, which increases man-hours associated with cutting/machining and often leads to elevated costs.

In view of the above drawbacks, an object of the present invention is to provide a terminal fitting that facilitates mounting of the insulating member and a method for assembling this terminal fitting.

Solution to Problem

In order to attain the above-described objectives, according to a first aspect of the present invention, there is provided a terminal fitting that comprises (a) an electrical contact portion having a cylindrical shape and configured to be inserted into a mating terminal fitting to be connected to the mating terminal fitting; (b) an insulating member made of insulating material and including (i) a to-be-received portion accommodated in the electrical contact portion and (ii) a to-be-exposed portion configured to be exposed to an outside via an end face of the electrical contact portion, and (c) a securing engagement portion provided on either one of the electrical contact portion and the insulating member and configured to be brought into fitting engagement with an other thereof.

The electrical contact portion includes a bottom wall having a surface upon which the to-be-received portion of the insulating member is disposed, a top wall positioning the to-be-received portion between the top wall and the bottom wall, and a joining wall continuing to the bottom wall and the top wall.

According to a second aspect of the present invention in the context of the first aspect thereof, the securing engagement portion is provided on the top wall and configured to be brought into fitting engagement with the to-be-received portion.

According to a third aspect of the present invention in the context of the above second aspect, the securing engagement portion is provided at a central portion with respect to an insertion direction in which the electrical contact portion is inserted into the mating terminal fitting.

According to a fourth aspect of the present invention in the context of the second or third aspect thereof, the securing engagement portion comprises an engagement portion that extends from the top wall toward the bottom wall and is configured to be brought into fitting engagement with a notch provided on the to-be-received portion.

According to a fifth aspect of the present invention in the context of the second aspect thereof, the securing engagement portion comprises a protrusion protruding from the top wall toward the bottom wall and configured to be brought into fitting engagement with a recess provided on the to-be-received portion.

According to a sixth aspect of the present invention in the context of the first aspect thereof, the securing engagement portion comprises a locking arm provided at a rear portion of the to-be-received portion in an insertion direction in which the electrical contact portion is inserted into the mating terminal fitting, and the locking arm is configured to be brought into fitting engagement with a rear portion of the top wall.

According to a seventh aspect of the present invention, there is provided a method for assembling a terminal fitting that comprises an electrical contact portion having a cylindrical shape and configured to be inserted into a mating terminal fitting to be connected to the mating terminal, wherein the electrical contact portion including a bottom wall, a joining wall continuing to the bottom wall, and a top wall continuing to the joining wall; an insulating member made of insulating material and including a to-be-received portion accommodated in the electrical contact portion and an to-be-exposed portion configured to be exposed to an outside via an end face of the electrical contact portion; and a securing engagement portion provided on one of the electrical contact portion and the insulating member and configured to be brought into fitting engagement with an other thereof.

The method comprises the steps of (a) placing the to-be-received portion of the insulating member upon the bottom wall in a state where the bottom wall, the joining wall, and the top wall are flush with each other; (b) bending the bottom wall, the joining wall, and the top wall relative to each other such that the joining wall is disposed in contact with an outer surface of the to-be-received portion and the to-be-received portion is positioned between the top wall and the bottom wall; and (c) bringing the securing engagement portion into fitting engagement with the to-be-received portion.

With the construction and arrangement of the terminal fitting according to the first aspect of the present invention, the electrical contact portion includes the bottom wall, the top wall, and the joining wall. Accordingly, the to-be-received portion can be attached to the electrical contact portion by exiting the state where these walls are flush with each other, and bending these walls with respect to these walls and placing these walls around the to-be-received portion.

With the construction and arrangement of the terminal fitting according to the second aspect of the present invention, the electrical contact portion includes the bottom wall, the top wall, and the joining wall. Accordingly, the to-be-received portion can be attached to the electrical contact portion by exiting the state where these walls are flush with each other, and bending these walls with respect to these walls and placing these walls around the to-be-received portion.

Also, the securing engagement portion is provided on the top wall, it is not necessary to provide a recess on the top wall of the electrical contact portion, the recess being configured to be brought into fitting engagement with the securing engagement portion.

With the construction and arrangement of the terminal fitting according to the third aspect of the present invention, the securing engagement portion is provided at the central portion of the electrical contact portion. Accordingly, when the electrical contact portion is inserted into the mating terminal fitting, the securing engagement portion can be protected against being caught on the inner surface of the mating terminal fitting.

With the construction and arrangement of the terminal fitting according to the fourth aspect of the present invention, the securing engagement portion comprises the engagement portion that extends from the top wall toward the bottom wall. Accordingly, the engagement portion serving as the securing engagement portion can be made without cutting and machining of the electrical contact portion.

With the construction and arrangement of the terminal fitting according to the fifth aspect of the present invention, the securing engagement portion comprises the protrusion raised from the top wall toward the bottom wall. Accordingly, the protrusion serving as the securing engagement portion can be made by press working without cutting or machining of the electrical contact portion.

With the construction and arrangement of the terminal fitting according to the sixth aspect of the present invention, the securing engagement portion comprises the locking arm provided at the rear portion of the to-be-received portion and configured to be brought into fitting engagement with the rear portion of the top wall. Accordingly, the locking arm serving as the securing engagement portion can be made without cutting and machining of the electrical contact portion.

According to the method of assembling the terminal fitting of the seventh aspect of the present invention, the to-be-received portion of the insulating member is disposed in contact with the bottom wall of the electrical contact portion, the joining wall of the electrical contact portion is disposed in contact with the outer surface of the to-be-received portion, and the top wall is disposed in contact with the bottom wall, and in this manner bending is provided, so that the securing engagement portion is brought into fitting engagement with the to-be-received portion, so that the insulating member can be fixed using the securing engagement portion.

Advantageous Effects of the Invention

As has been described in the foregoing, the invention according to the first aspect has the following advantageous effects. The to-be-received portion can be attached to the electrical contact portion by bending the bottom wall, the joining wall, and the top wall between these walls such that they are wound around the to-be-received portion. Accordingly the to-be-received portion of the insulating member does not need to be press-fitted into the cylindrical electrical contact portion. By virtue of this feature, even when the retaining arm that is elastically deformable and susceptible to damage is provided on the to-be-received portion, it is made possible to secure the insulating member in the electrical contact portion without causing damage to the retaining arm. Thus, it is made possible to reliably attach the insulating member to the electrical contact portion and accordingly to the terminal fitting without causing damage to the insulating member.

The invention according to the second aspect has the following advantageous effects. A recess with which the securing engagement portion is brought into fitting engagement does not need to be provided on the electrical contact portion such as the top wall. In addition to the effects according to the first aspect, cutting or machining of the electrical contact portion does not need to be performed. Accordingly, it is made possible to prevent increase in man-hours associated with machining, and provide the terminal fitting in a cost-effective manner.

The invention according to the third aspect has the following advantageous effects. When the electrical contact portion is inserted into the mating terminal fitting, the securing engagement portion can be protected against being caught on the inner surface of the mating terminal fitting. Accordingly, reliable connection to the mating terminal fitting can be ensured.

The invention according to the fourth to sixth aspects has the following advantageous effects. The engagement portion serving as the securing engagement portion can be made without cutting and machining of the electrical contact portion. Accordingly, it is made possible to prevent increase in man-hours associated with machining, and provide the terminal fitting in a cost-effective and reliable manner.

The invention according to the seventh aspect has the following advantageous effects. Since the securing engagement portion is brought into fitting engagement with the to-be-received portion by bending it between the walls, the to-be-received portion of the insulating member does not need to be press-fitted into the cylindrical electrical contact portion. By virtue of this feature, even when the retaining arm that is elastically deformable and susceptible to damage is provided on the to-be-received portion, it is made possible to secure the insulating member in the electrical contact portion without causing damage to the retaining arm. Accordingly, it is made possible to reliably attach the insulating member to the electrical contact portion and accordingly to the terminal fitting without causing damage to the insulating member.

DESCRIPTION OF EXEMPLARY EMBODIMENTS

A male-type terminal fitting 1 (hereinafter referred to as a male terminal) according to a first embodiment of the present invention is described below with reference to FIGS. 1 to 11, the male terminal 1 serving as a "terminal fitting" in the context of the present invention.

Figure 1:
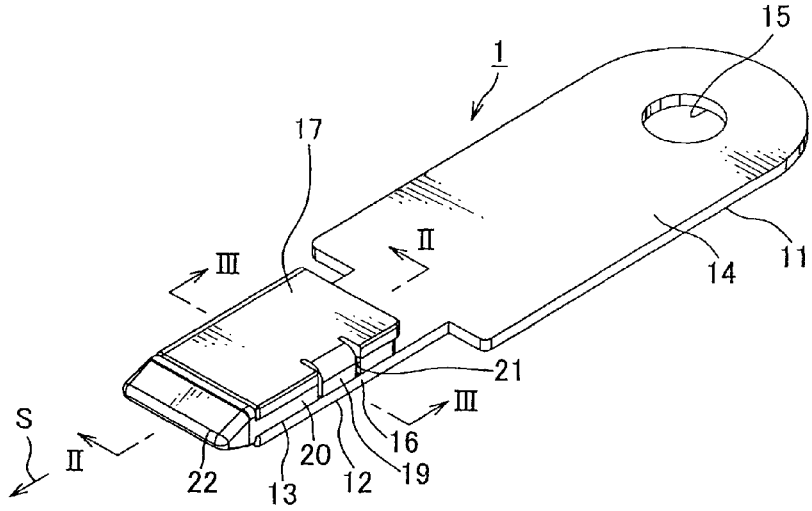
FIG. 1 is a perspective view of a male terminal according to a first embodiment of the present invention.

The male terminal 1 shown in FIG. 1 is configured to be connected to a female-type terminal fitting 2 (hereinafter referred to as a female terminal), which serves as a "mating terminal fitting" in the context of the present invention (shown in FIG. 10).

The female terminal 2 may be made from a conductive sheet metal. As shown in FIGS. 10 and 11, the female terminal 2 comprises a wire-connecting portion 3 and an electrical contact part 4. The wire-connecting portion 3 includes in one piece therewith a bottom wall 5 adapted to position an electrical wire on a surface thereof and a pair of crimping pieces 6 each extending from corresponding ends in a width direction of the bottom wall 5.

The crimping pieces 6 are adapted to be bent in a direction toward the bottom wall 5 such that a core wire of the electrical wire is clamped between the crimping pieces 6 and the bottom wall 5 so as to crimp the core wire of the electrical wire. The wire-connecting portion 3 is electrically connected to the electrical wire and secured thereto through crimping of the core wire of the electrical wire by the crimping pieces 6.

As shown in FIG. 11, the electrical contact part 4 includes a cylindrical contact-part main body 7 continuing to the bottom wall 5 of the wire-connecting portion 3 and a spring portion 8 accommodated in the contact-part main body 7.

The contact-part main body 7 has a shape of a quadrangular prism with one wall of the contact-part main body 7 continuing to the bottom wall 5.

The spring portion 8 includes in one piece therewith multiple pairs of springs 9 adapted to sandwich a later-described electrical contact portion 12 of the male terminal 1 therebetween, and a connecting plate part 10 that connects the springs 9 to each other.

It is appreciated that each pair of the springs 9 are constructed and arranged to sandwich the electrical contact portion 12 of the male terminal 1 therebetween. The multiple pairs of springs 9 are spaced from each other in a direction S in which the electrical contact portion 12 of the male terminal 1 is inserted into the electrical contact part 4 of the female terminal 2 (hereinafter referred to as an "insertion direction," which is indicated by an arrow in the associated figures).

When the electrical contact portion 12 of the male terminal 1 is inserted into the electrical contact part 4, each pair of the springs 9 are pressed by the electrical contact portion 12 in a direction away from each other, so that an elastic restoration force is generated that urges the electrical contact portion 2 toward the center of the electrical contact part 4.

In a state where the elastic restoration force is generated by which the springs 9 urges the electrical contact portion 12 of the male terminal 1 toward the center of the electrical contact part 4, the electrical contact part 4 is in contact with the electrical contact portion 12 of the male terminal 1, and thus the electrical contact part 4 is electrically and mechanically connected to the electrical contact portion 12 of the male terminal 1.

Referring to FIG. 1, the male terminal 1 includes (a) a connector-block connecting part 11, (b) the electrical contact portion 12, (c) an insulating member 13, and (d) an engagement portion 19 (shown in FIG. 3), the engagement portion 19 serving as a "securing engagement portion" in the context of the present invention.

The connector-block connecting part 11, the electrical contact portion 12, and the engagement portion 19 are made in one piece with each other by punching and bending a single conductive sheet metal. Accordingly, the connector-block connecting part 11, the electrical contact portion 12, and the engagement portion 19 are electrically conductive.

The connector-block connecting part 11 includes a flat-plate-shaped connecting-part main body 14 and a through-hole 15 provided in the connecting-part main body 14. The shape of the through-hole 15 is circular in plan view. The connector-block connecting part 11 is connected to a not-shown connector block by arranging the connecting-part main body 14 upon the connector block with a nut screwed onto a bolt, the bolt being inserted into the through-hole 15 and the nut being embedded in the connector block such that the connecting-part main body 14 resides between the connector block and a head of the bolt.

Figure 2:
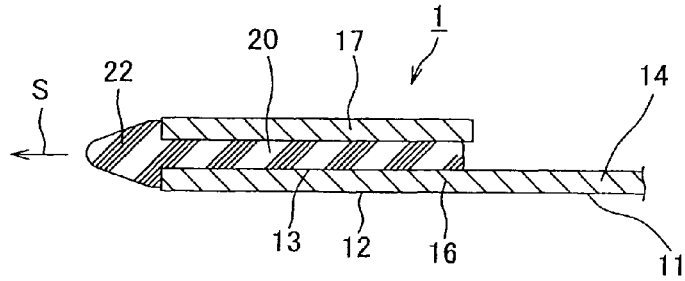
FIG. 2 is a cross-sectional view taken along the line II-II in FIG. 1.
Figure 3:
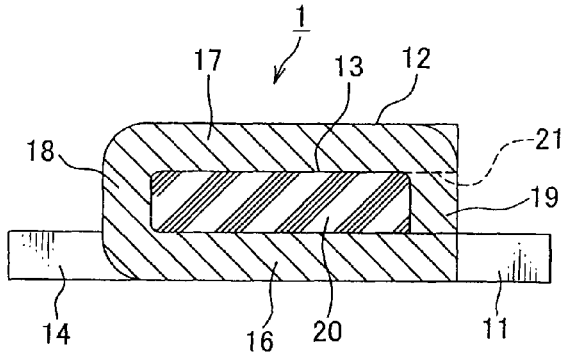
FIG. 3 is a cross-sectional view taken along the line III-III in FIG. 1.

The electrical contact portion 12 has a thickness slightly smaller than that of the electrical contact part 4 of the previously-described female terminal 2, has a width smaller than that of the electrical contact part 4 of the female terminal 2, and has a flat cylindrical shape. As shown in FIGS. 2 and 3, the electrical contact portion 12 includes in one piece therewith (i) a bottom wall 16 continuing to the connecting-part main body 14 of the connector-block connecting part 11, (ii) a top wall 17 spaced from and opposed to the bottom wall 16 and extending parallel to the bottom wall 16, and (iii) a joining wall 18 (shown in FIG. 3), and further includes in one piece therewith (iv) the engagement portion 19.

The joining wall 18 connects one edge in a width direction of the bottom wall 16 and one edge in a width direction of the top wall 17 to each other. In this manner, the top wall 17 continues to the bottom wall 16 via the joining wall 18, and the joining wall 18 continues both to the bottom wall 16 and the top wall 17.

The engagement portion 19 is provided on the other edge of the top wall 17 in its width direction. Also, the engagement portion 19 is provided at the central portion of the other edge of the top wall 17 in the insertion direction S. The engagement portion 19 extends from the other edge of the top wall 17 toward the other edge of the bottom wall 16 in its width direction, and is configured to be brought into fitting engagement with a later-described notch 21 provided on the insulating member 13 and accordingly with a to-be-received portion 20, whose end face is disposed in contact with the other edge of the bottom wall 16.

Figure 4:
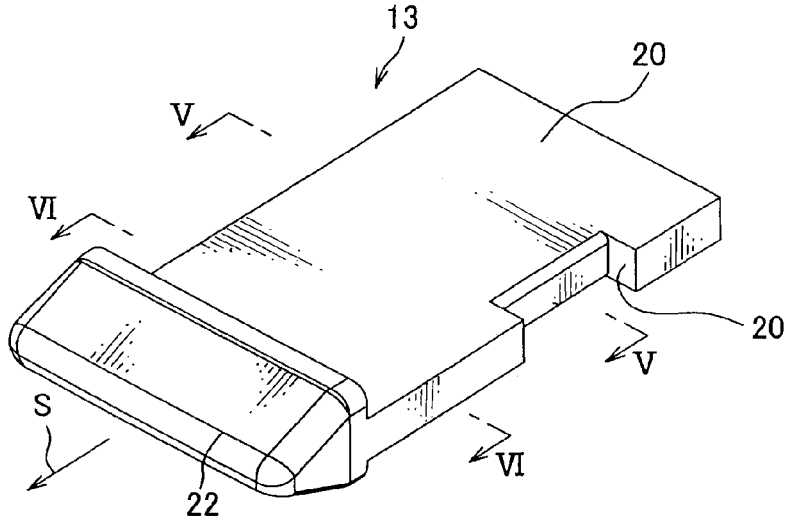
FIG. 4 is a cross-sectional view of an insulating member of the male terminal shown in FIG. 1.

The insulating member 13 is made of an insulating material (insulating body) such as insulating synthetic resin. As shown in FIG. 4, the insulating member 13 includes in one piece therewith (i) the flat plate-shaped to-be-received portion 20, (ii) the notch 21, and (iii) a to-be-exposed portion 22.

The size of the to-be-received portion 20 is substantially the same as that of a space defined by the bottom wall 16, the joining wall 18, and the top wall 17. The to-be-received portion 20 is positioned in this space and arranged between the bottom wall 16 and the top wall 17. In other words, the to-be-received portion 20 is positioned on the surface of the bottom wall 16.

Figure 5:
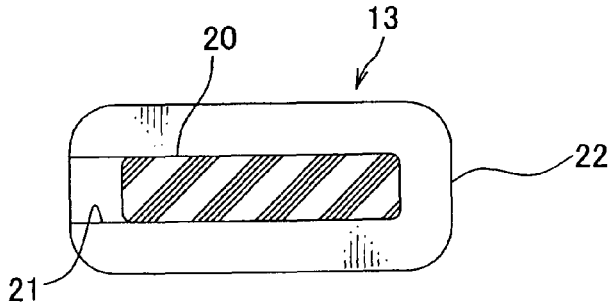
FIG. 5 is a cross-sectional view taken along the line V-V in FIG. 4.

Referring to FIGS. 4 and 5, the notch 21 is provided at a central portion of one edge to be recessed therefrom, the one edge being between the other edges of the bottom wall 16 and the top wall 17 of the to-be-received portion 20. The previously-described engagement portion 19 is configured to enter the notch 21 so that the engagement portion 19 is brought into fitting engagement with the notch 21.

Figure 6:
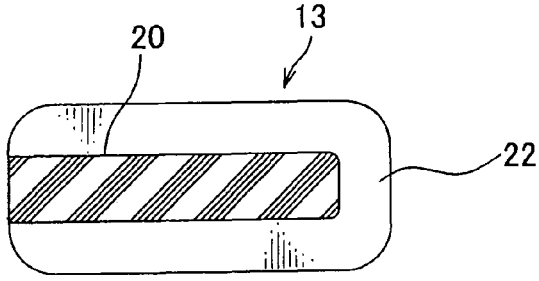
FIG. 6 is a cross-sectional view taken along the line VI-VI in FIG. 4.

The to-be-exposed portion 22 continues to an end of the to-be-received portion 20 on the side close to the female terminal 2, and, as shown in FIG. 6, protrudes toward a periphery from the edge of the to-be-received portion 20 other than the edge where the previously-described notch 21 is provided. When the to-be-received portion 20 is positioned between the bottom wall 16 and the top wall 17, the to-be-exposed portion 22 is disposed in contact with and over the entire end face of the electrical contact portion 12. The to-be-exposed portion 22 tapers as it becomes away from the electrical contact portion 12, i.e., towards the female terminal 2. When the to-be-received portion 20 is positioned between the bottom wall 16 and the top wall 17 and accommodated in the electrical contact portion 12, the to-be-exposed portion 22 remains exposed to the outside via the end face of the electrical contact portion 12.

Since the above-described insulating member 13 includes the to-be-exposed portion 22 configured to cover the entire end face of the electrical contact portion 12, it is ensured that touching the end portion by an operator do not cause electrical shock even when a large current flows.

The male terminal 1 having the above-described configuration is assembled in the following manner.

Figure 7:
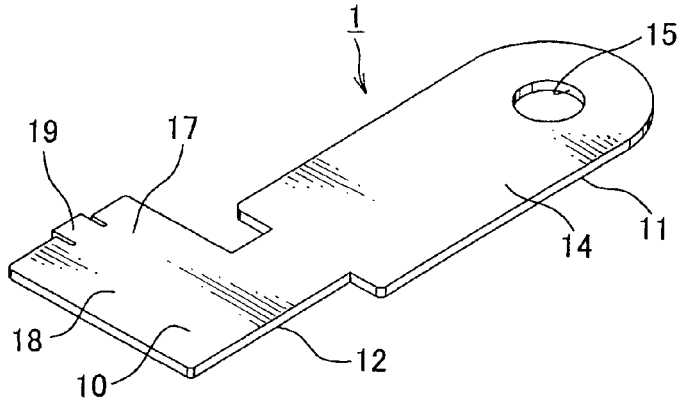
FIG. 7 is a perspective view illustrating a state in which the male terminal's connector-block connecting part, bottom wall, joining wall, top wall, and engagement portion of FIG. 1 are flush with each other.

First, the connector-block connecting part 11, the bottom wall 16, the joining wall 18, the top wall 17, and the engagement portion 19 of the electrical contact portion 12 are made with punching made on a conductive sheet metal, as shown in FIG. 7 such that they continue to each other and are flush with each other. In this regard, a plurality of the male terminals 1 may continue to each other in a not-shown chained manner.

Figure 8:
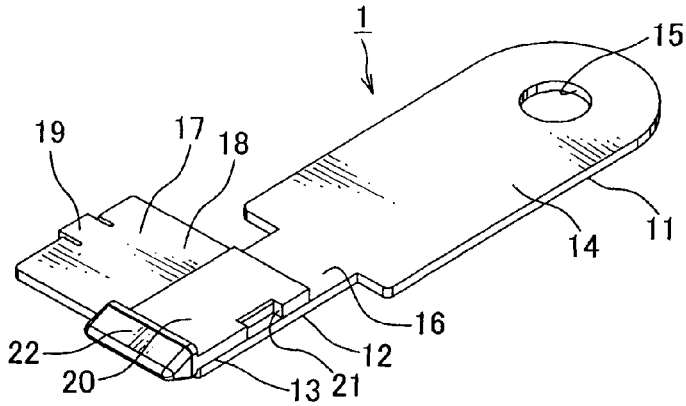
FIG. 8 is a perspective view illustrating a state in which a to-be-received portion of the insulating member is disposed in an overlapping manner upon the bottom wall of the male terminal shown in FIG. 7.

As shown in FIG. 8, the to-be-received portion 20 of the insulating member 13 is placed on (disposed in contact with) the bottom wall 16. At this point, one edge of the to-be-received portion 20 where the notch 21 is provided is disposed on and in contact with the other edge of the previously-described bottom wall 16, and the to-be-exposed portion 22 is disposed in contact with the end face of the bottom wall 16. After that, bending work is performed for the male terminal 1 such that the joining wall 18 upstands from the bottom wall 16 and resides in contact with the outer surface of the to-be-received portion 20, the top wall 17 is disposed in contact with the outer surface of the to-be-received portion 20, and the top wall 17 and the bottom wall 16 extend parallel to each other. Further, the engagement portion 19 is brought into fitting engagement with the notch 21.

Figure 9:
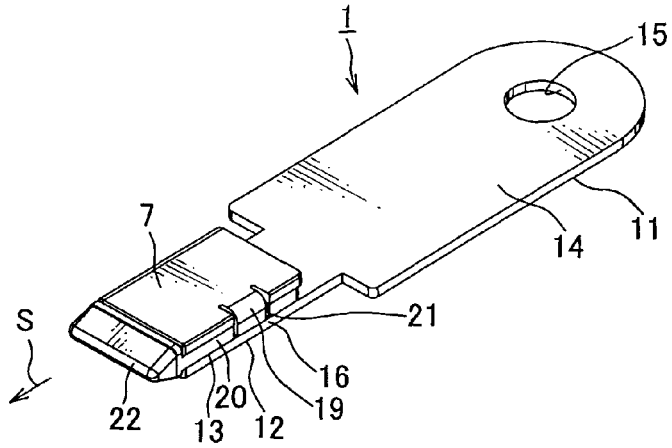
FIG. 9 is a perspective view of the male terminal shown in FIG. 8 in a state where the to-be-received portion is positioned between the top wall and the bottom wall, and the engagement portion is bent such that it is brought into fitting engagement with the to-be-received portion.

Restated, the male terminal 1 is bent such that the joining wall 18 is disposed in contact with the outer surface of the to-be-received portion 20, the to-be-received portion 20 is positioned between the top wall 17 and the bottom wall 16, and the engagement portion 19 is brought into fitting engagement with the notch 21 to be in fitting engagement with the to-be-received portion 20. In this manner, as shown in FIG. 9, the male terminal 1 is assembled.

Figure 10:
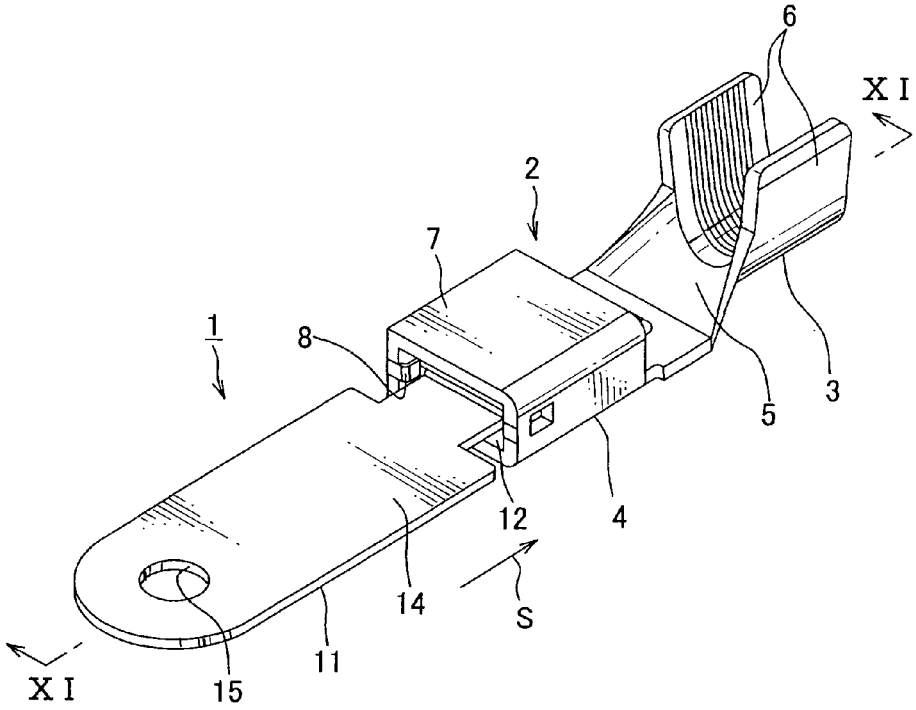
FIG. 10 is a perspective view of the male terminal shown in FIG. 1 in a state where the male terminal is connected to a female terminal.
Figure 11:
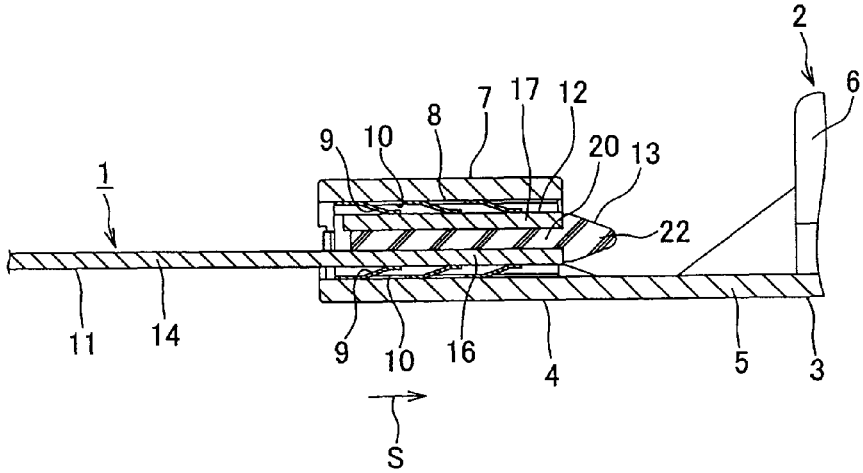
FIG. 11 is a cross-sectional view taken along the line XI-XI in FIG. 10.

The male terminal 1 that has been assembled in this manner, so that the connector-block connecting part 11 is attached to the connector block, the electrical contact portion 12 is inserted into the electrical contact part 4 of the female terminal 2, and, as shown in FIGS. 10 and 11, connected to the female terminal 2.

It should be noted that, in this embodiment, the bottom wall 16, the to-be-received portion 20, and the top wall 17 are disposed in close contact with each other as shown in FIG. 3.

According to this embodiment, the electrical contact portion 12 includes the bottom wall 16, the top wall 18, and the joining wall 17. Accordingly, the to-be-received portion 20 can be attached to the electrical contact portion 12 by exiting the state where these walls 16, 17, 18 are flush with each other, and bending these walls 16, 17, 18 relative to each other and placing these walls 16, 17, 18 around the to-be-received portion 20.

By virtue of this feature, the to-be-received portion 20 of the insulating member 13 does not need to be press-fitted into the cylindrical electrical contact portion 12, and it is not necessary to provide a retaining arm on the to-be-received portion 20, the retaining arm being elastically deformable and susceptible to damage. Even when the retaining arm has to be provided, the insulating member 13 can be secured in the electrical contact portion 12 without causing damage to the retaining arm. Accordingly, the insulating member 13 is reliably attached to the electrical contact portion 12 without causing damage to the insulating member 13.

Also, since the engagement portion 19 is provided on the top wall 17, the engagement portion 19 being adapted to be brought into fitting engagement with the to-be-received portion 20 of the insulating member 13, it is not necessary for the top wall 17 and accordingly the electrical contact portion 12 to include a recess with which the engagement portion 19 has to be brought into fitting engagement. By virtue of this feature, the electrical contact portion 12 does not need to be cut or machined. Accordingly, it is made possible to prevent increase in man-hours associated with machining, and provide the male terminal 1 in a cost-effective manner.

Since the engagement portion 19 is provided at the center of the electrical contact portion 12, it is made possible to prevent the engagement portion 19 from being caught on an inner surface of the electrical contact part 4 of the female terminal 2 as the electrical contact portion 12 is inserted into the electrical contact part 4 of the female terminal 2, with the engagement portion 19 covered by the top wall 17. Accordingly, it is made possible to provide reliable connection of the male terminal 1 to the female terminal 2.

Since the engagement portion 19 extends from the top wall 17 toward the bottom wall 16, it is made possible to make the engagement portion 19 without cutting or machining the electrical contact portion 12. Accordingly, it is made possible to prevent increase in man-hours associated with machining, and provide the male terminal 1 in a cost-effective and reliable manner.

Figure 12:
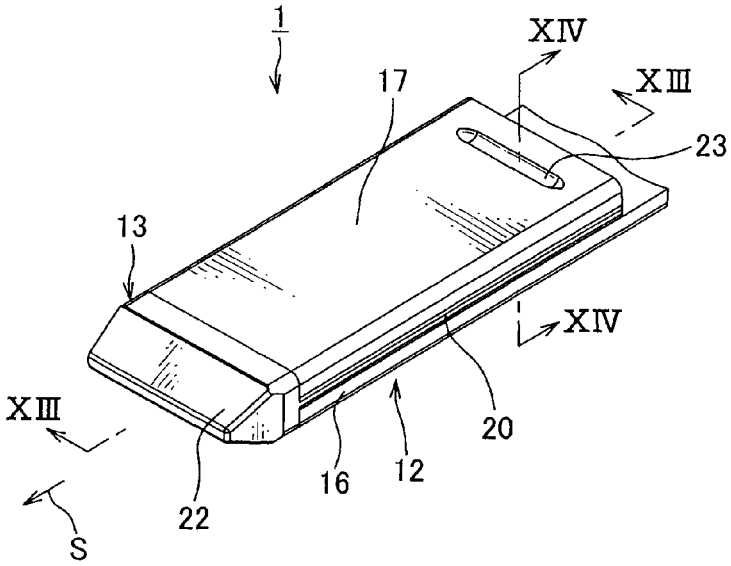
FIG. 12 is a perspective view of a principal part of a male terminal according to a second embodiment of the present invention.
Figure 13:
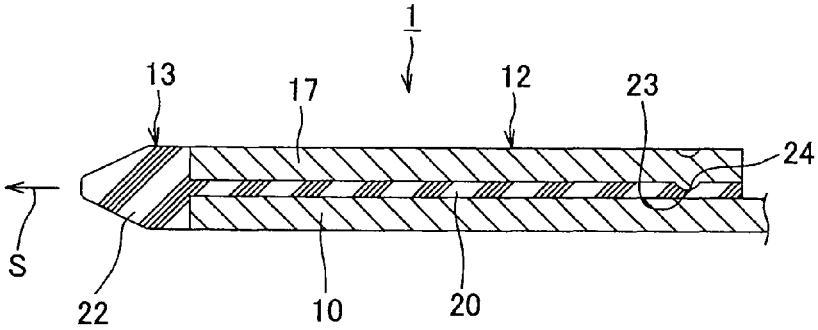
FIG. 13 is a cross-sectional view taken along the line XIII-XIII in FIG. 12.
Figure 14:
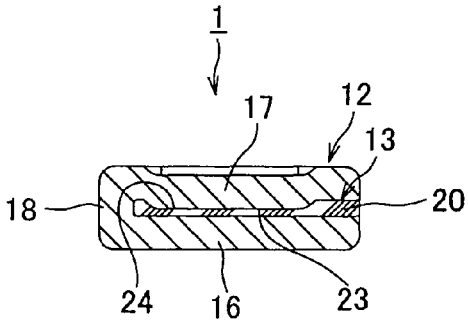
FIG. 14 is a cross-sectional view taken along the line XIV-XIV in FIG. 12.

Next, the following describes the male terminal 1, which serves as the terminal fitting, according to a second embodiment of the present invention with reference to FIGS. 12 to 14, in which like reference signs represent the same or similar elements as in the previously-described first embodiment explanation of which is omitted.

Referring to FIG. 12, the male terminal 1 in this embodiment includes a protrusion 23 serving as the securing engagement portion. As shown in FIGS. 13 and 14, the protrusion 23 is provided by making a curved part on the top wall 17 of the electrical contact portion 12, the curved part protruding from the top wall 17 of the electrical contact portion 12 toward the bottom wall 16. The protrusion 23 is provided at the end of the electrical contact portion 12 on the side close to the connector-block connecting part 11, i.e., at the end on the side close to the rear portion in the insertion direction S. The protrusion 23 extends straight in a direction orthogonal to the longitudinal direction of the electrical contact portion 12. The protrusion 23 is configured to be brought into fitting engagement with a recess 24 provided on and recessed with respect to the surface of the to-be-received portion 20 of the insulating member 13 facing the top wall 17 (shown in FIGS. 13 and 14).

The male terminal 1 of this embodiment is assembled in the same manner as in the previously-described first embodiment. However, in this embodiment, it should be noted that the protrusion 23 is already provided in the state where the connector-block connecting part 11, the bottom wall 16, the joining wall 18, the top wall 17 of the electrical contact portion 12, and the engagement portion 19 continue to each other and are flush with each other.

According to this embodiment, in the same manner as in the previously-described first embodiment, the electrical contact portion 12 includes the bottom wall 16, the top wall 18, and the joining wall 17. Accordingly, the to-be-received portion 20 can be attached to the electrical contact portion 12 by exiting the state where these walls 16, 17, 18 are flush with each other, and bending these walls 16, 17, 18 relative to each other and placing these walls 16, 17, 18 around the to-be-received portion 20.

By virtue of this feature, the to-be-received portion of the insulating member 13 does not need to be press-fitted into the cylindrical electrical contact portion 12, and accordingly the retaining arm that is elastically deformable and susceptible to damage does not need to be provided on the to-be-received portion 20. Even when the retaining arm has to be provided on the to-be-received portion 20, the insulating member 13 can be secured in the electrical contact portion 12 without causing damage to the retaining arm. Accordingly, the insulating member 13 is reliably attached to the electrical contact portion 12 without causing damage to the insulating member 13.

Also, since the protrusion 23 is provided on the top wall 17, the protrusion 23 being adapted to be brought into fitting engagement with the to-be-received portion 20 of the insulating member 13, it is not necessary for the top wall 17 and accordingly the electrical contact portion 12 to include a recess with which the engagement portion 19 is brought into fitting engagement. By virtue of this feature, the electrical contact portion 12 does not need to be cut or machined. Accordingly, it is made possible to prevent increase in man-hours associated with machining, and provide the male terminal 1 in a cost-effective manner.

Figure 15:
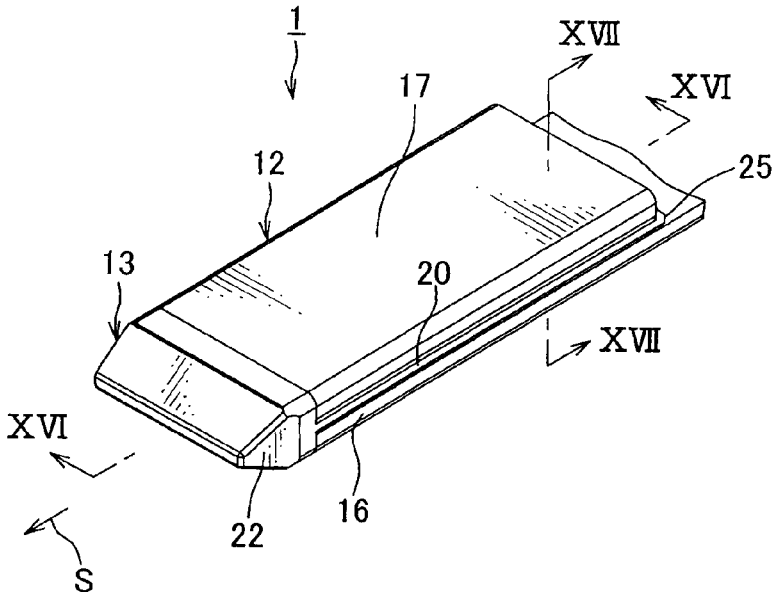
FIG. 15 is a perspective view of a principal part of a male terminal according to a third embodiment of the present invention.
Figure 16:
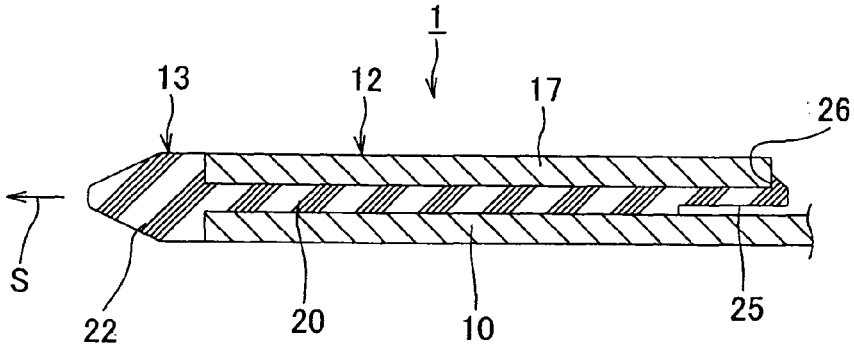
FIG. 16 is a cross-sectional view taken along the line XVI-XVI in FIG. 15.

Next, the following describes a male terminal 1, which serves as the terminal fitting, according to a third embodiment of the present invention with reference to FIGS. 15 and 16. Like elements have the like reference sings as in the previously-described first and second embodiments, explanation of which is omitted.

Referring to FIG. 15, the male terminal 1 of this embodiment includes a locking arm 25 which serves as the securing engagement portion. The locking arm 25 is provided, as shown in FIG. 16, at a rear end of the insulating member 13 with respect to the insertion direction S in which the to-be-received portion 20 is inserted. The locking arm 25 extends in the insertion direction S, i.e., in a straight manner in parallel with the longitudinal direction of the electrical contact portion 12. Provided at its end is a nail portion 26 at a rearmost end in the insertion direction S. The nail portion 26 is configured to be brought into fitting engagement with the top wall 17 at a rear end thereof in the insertion direction S. The male terminal 1 of this embodiment is assembled in the same manner as in the previously-described first embodiment.

According to this embodiment, as in the same manner as in the previously-described first embodiment, the electrical contact portion 12 includes the bottom wall 16, the top wall 18, and the joining wall 17. Accordingly, the to-be-received portion 20 can be attached to the electrical contact portion 12 by exiting the state where these walls 16, 17, 18 are flush with each other, and bending these walls 16, 17, 18 relative to each other and placing these walls 16, 17, 18 around the to-be-received portion 20. By virtue of this feature, the to-be-received portion of the insulating member 13 does not need to be press-fitted into the cylindrical electrical contact portion 12, and accordingly the retaining arm that is elastically deformable and susceptible to damage does not need to be provided on the to-be-received portion 20. Even when the retaining arm has to be provided thereon, it is made possible to secure the insulating member 13 in the electrical contact portion 12 without causing damage to the retaining arm.

Accordingly, the insulating member 13 is reliably attached to the electrical contact portion 12 without causing damage to the insulating member 13.

Also, since the locking arm 25 is provided on the to-be-received portion 20 of the insulating member 13, the locking arm 25 being adapted to be brought into fitting engagement with the rear end of the top wall 17 of the electrical contact portion 12, it is not necessary for the top wall 17 and accordingly the electrical contact portion 12 to include a recess with which the locking arm 25 is brought into fitting engagement. By virtue of this feature, the electrical contact portion 12 does not need to be cut or machined. Accordingly, it is made possible to prevent increase in man-hours associated with machining, and provide the male terminal 1 in a cost-effective manner.

In the above-described embodiments, the male terminal 1 includes the connector-block connecting part 11. Meanwhile, the terminal fitting of the present invention may of course include a wire-connecting portion in place of the connector-block connecting part 11, wire-connecting portion being adapted to be welded or pressure-welded to an electrical wire. Also, in these embodiments, the bottom wall 16, the to-be-received portion 20, and the top wall 17 may be provided in such a manner that they are not disposed in a closely overlapping manner but disposed to be spaced from each other.

It should be noted that the embodiments have only been illustrated as a typical illustrations of the present invention, and the present invention is in no way limited to the illustrated embodiments. Hence, the present invention can be effectuated with various modifications made thereto within the scope of the present invention.

REFERENCE SIGNS

1 Male terminal (terminal fitting)
2 Female terminal (mating terminal fitting)
12 Electrical contact portion
13 Insulating member
16 Bottom wall
17 Top wall
19 Engagement portion (securing engagement portion)
20 To-be-received portion
21 Notch
22 To-be-exposed portion
23 Protrusion (securing engagement portion)
24 Recess
25 Locking arm (securing engagement portion)
S Insertion direction

The invention claimed is:

1. A terminal fitting comprising:

(a) an electrical contact portion having a cylindrical shape and adapted to be inserted into a mating terminal fitting to be connected to the mating terminal fitting;

(b) an insulating member made of an insulating material and including a to-be-received portion configured to be accommodated in the electrical contact portion and an to-be-exposed portion configured to be exposed to an outside via an end face of the electrical contact portion, wherein the electrical contact portion includes a bottom wall having a surface upon which the to-be-received portion of the insulating member is disposed, a top wall positioning the to-be-received portion between the top wall and the bottom wall, and a joining wall continuing to the bottom wall and the top wall; and (c) a securing engagement portion provided on either one of the electrical contact portion and the insulating member and configured to be brought into fitting engagement with an other thereof.

2. The terminal fitting as set forth in claim 1, wherein the securing engagement portion is provided on the top wall and configured to be brought into fitting engagement with the to-be-received portion.

3. The terminal fitting as set forth in claim 2, wherein the securing engagement portion is provided at a central portion with respect to an insertion direction in which the electrical contact portion is inserted into the mating terminal fitting.

4. The terminal fitting as set forth in claim 2, wherein the securing engagement portion comprises an engagement portion that extends from the top wall toward the bottom wall and is configured to be brought into fitting engagement with a notch provided on the to-be-received portion.

5. The terminal fitting as set forth in claim 2, wherein the securing engagement portion comprises a protrusion protruding from the top wall toward the bottom wall and configured to be brought into fitting engagement with a recess provided on the to-be-received portion.

6. The terminal fitting as set forth in claim 1, wherein the securing engagement portion comprises a locking arm provided at a rear portion of the to-be-received portion in an insertion direction in which the electrical contact portion is inserted into the mating terminal fitting, and the locking arm is configured to be brought into fitting engagement with a rear portion of the top wall.

7. A method for assembling a terminal fitting that comprises an electrical contact portion having a cylindrical shape and adapted to be inserted into a mating terminal fitting to be connected to the mating terminal, wherein the electrical contact portion including a bottom wall, a joining wall continuing to the bottom wall, and a top wall continuing to the joining wall; an insulating member made of insulating material and including a to-be-received portion accommodated in the electrical contact portion and an to-be-exposed portion configured to be exposed to an outside via an end face of the electrical contact portion; and a securing engagement portion provided on one of the electrical contact portion and the insulating member and adapted to be brought into fitting engagement with an other thereof, the method comprising:

(a) placing the to-be-received portion of the insulating member upon the bottom wall in a state where the bottom wall, the joining wall, and the top wall are flush with each other;

(b) bending the bottom wall, the joining wall, and the top wall relative to each other such that the joining wall is disposed in contact with an outer surface of the to-be-received portion and the to-be-received portion is positioned between the top wall and the bottom wall; and (c) bringing the securing engagement portion into fitting engagement with the to-be-received portion.

8. The terminal fitting as set forth in claim 3, wherein the securing engagement portion comprises an engagement portion that extends from the top wall toward the bottom wall and is configured to be brought into fitting engagement with a notch provided on the to-be-received portion.

* * * * *